US012723479B2

(12) United States Patent
Hoelscher et al.

(10) Patent No.: US 12,723,479 B2
(45) Date of Patent: Sep. 1, 2026

(54) INSENSITIVE HIGH EXPLOSIVE BASED TUBING CUTTER

(71) Applicant: Halliburton Energy Services, Inc., Houston, TX (US)

(72) Inventors: Christopher C. Hoelscher, Arlington, TX (US); Jason Paul Metzger, Joshua, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 24 days.

(21) Appl. No.: 16/596,994

(22) Filed: Oct. 9, 2019

(65) Prior Publication Data

US 2020/0208485 A1 Jul. 2, 2020

(51) Int. Cl.
*E21B 29/02* (2006.01)
*F42B 1/028* (2006.01)
*F42B 1/032* (2006.01)

(52) U.S. Cl.
CPC ..... *E21B 29/02* (2013.01); *F42B 1/028* (2013.01); *F42B 1/032* (2013.01)

(58) Field of Classification Search
CPC ..... E21B 29/02; F42B 1/028; F42B 1/032
USPC ..... 166/297
See application file for complete search history.

(56) References Cited

U.S. PATENT DOCUMENTS 3,233,688 A * 2/1966 Bell ..... E21B 29/02 175/4.6
4,481,371 A * 11/1984 Benziger ..... C07C 209/10 149/105
5,035,843 A * 7/1991 Schmid ..... B29B 7/726 264/3.2
5,046,563 A * 9/1991 Engel ..... F42B 3/08 166/297
5,129,322 A 7/1992 Christopher et al.
5,597,974 A 1/1997 Voreck et al.
6,792,866 B2 9/2004 Grattan
10,041,320 B2 8/2018 Clemens
2005/0247450 A1* 11/2005 Ratanasirigulchai ... E21B 35/00 166/378
2006/0075888 A1* 4/2006 Yang ..... F42B 3/08 89/1.14
2009/0114382 A1 5/2009 Grove et al.
2010/0006193 A1* 1/2010 Kneisl ..... F42D 3/06 166/299
2011/0094406 A1 4/2011 Marya et al.
2011/0283872 A1* 11/2011 Brooks ..... E21B 29/02 166/299
2013/0061771 A1* 3/2013 Betancourt ..... F42B 3/08 102/307

(Continued)

FOREIGN PATENT DOCUMENTS

CN 100445240 C 12/2008
EP 1367354 A1 12/2003

*Primary Examiner* — Taras P Bemko
(74) *Attorney, Agent, or Firm* — Benjamin Ford; Parker Justiss, P.C.

(57) ABSTRACT

Provided is a shaped charge for use in a radial cutter. The shaped charge, in one example, includes a circular charge formed into a predetermined shape, the predetermined shape selected to form a concave edge. The circular charge, in this example, is formed from a Triaminotrinitrobenzene based material. The shaped charge, in this example, additionally includes a liner shaped to extend along the concave edge.

27 Claims, 6 Drawing Sheets

(56) References Cited

U.S. PATENT DOCUMENTS

| | | | | |
|---|---|---|---|---|
| 2013/0284441 | A1* | 10/2013 | Brooks | E21B 29/02 166/299 |
| 2017/0122082 | A1 | 5/2017 | Lin | |
| 2017/0241244 | A1 | 8/2017 | Barker et al. | |

* cited by examiner

INSENSITIVE HIGH EXPLOSIVE BASED TUBING CUTTER

CROSS-REFERENCE TO RELATED APPLICATION

This application claims priority to International Application Serial No. PCT/US2018/067610, filed on Dec. 27, 2018, and entitled "INSENSITIVE HIGH EXPLOSIVE BASED TUBING CUTTER," is commonly assigned with this application and incorporated herein by reference in its entirety.

BACKGROUND

The use of shaped-charges for cutting tubular goods such as production tubing, drill pipe, or casings used to line wells such as oil and natural gas wells and the like, is well-known in the art. Generally, shaped-charges utilized as tubing cutters include a circular, also described as annular or ring shaped, explosive element having a concave surface around its outer circumference. The concave surface normally has a V shaped cross section. The concave surface of the explosive is lined with a thin metal liner which, as is well known in the art, is explosively driven to hydrodynamically form a flat disk shaped jet of material with fluid-like properties upon detonation of the explosive. This jet of viscous material exhibits a good penetrating power to cut tubing. The shaped charge is often manufactured in the form of two identical half charges, top and bottom halves, each comprising explosive material pressed onto a half liner. Two such half charges may be assembled to form a complete shaped charge.

Generally, explosive materials such as HMX, RDX, PYX, HNS, or PETN, among others, are coated or blended with binders such as wax or synthetic polymeric reactive binders such as chlorotrifluoroethylene, sold under the registered trademark NEOFLON by Daikin Industries (formerly available from 3M Corporation under the trademark KEL-F) or a fluoroelastomer sold by DuPont Dow Elastomers L.L.C. under the registered trademark VITON. The resultant mixture is cold- or hot-pressed directly into a shaped-charge case or onto a full or half liner. The resulting shaped-charges are initiated by means of a booster or priming charge in the form of a pellet positioned in the center of the circular main charge and located so that a detonating fuse, detonating cord or electrical detonator may be positioned in close proximity to the priming charge.

The shipment of explosives is carefully regulated by various government agencies, primarily for safety purposes. The regulations impose various levels of restrictions depending upon type of explosive, weight of individual explosive components, total weight in an individual package, relative positioning of multiple explosive components in a single package, types of packaging materials and other factors. It is desirable for the explosives used in shaped charges to meet the requirements for the least restrictive shipping rules both because it reduces the expense and time for shipping and means that the risk of accidents has been minimized.

BRIEF DESCRIPTION

Reference is now made to the following descriptions taken in conjunction with the accompanying drawings, in which.

DETAILED DESCRIPTION

Figure 1:
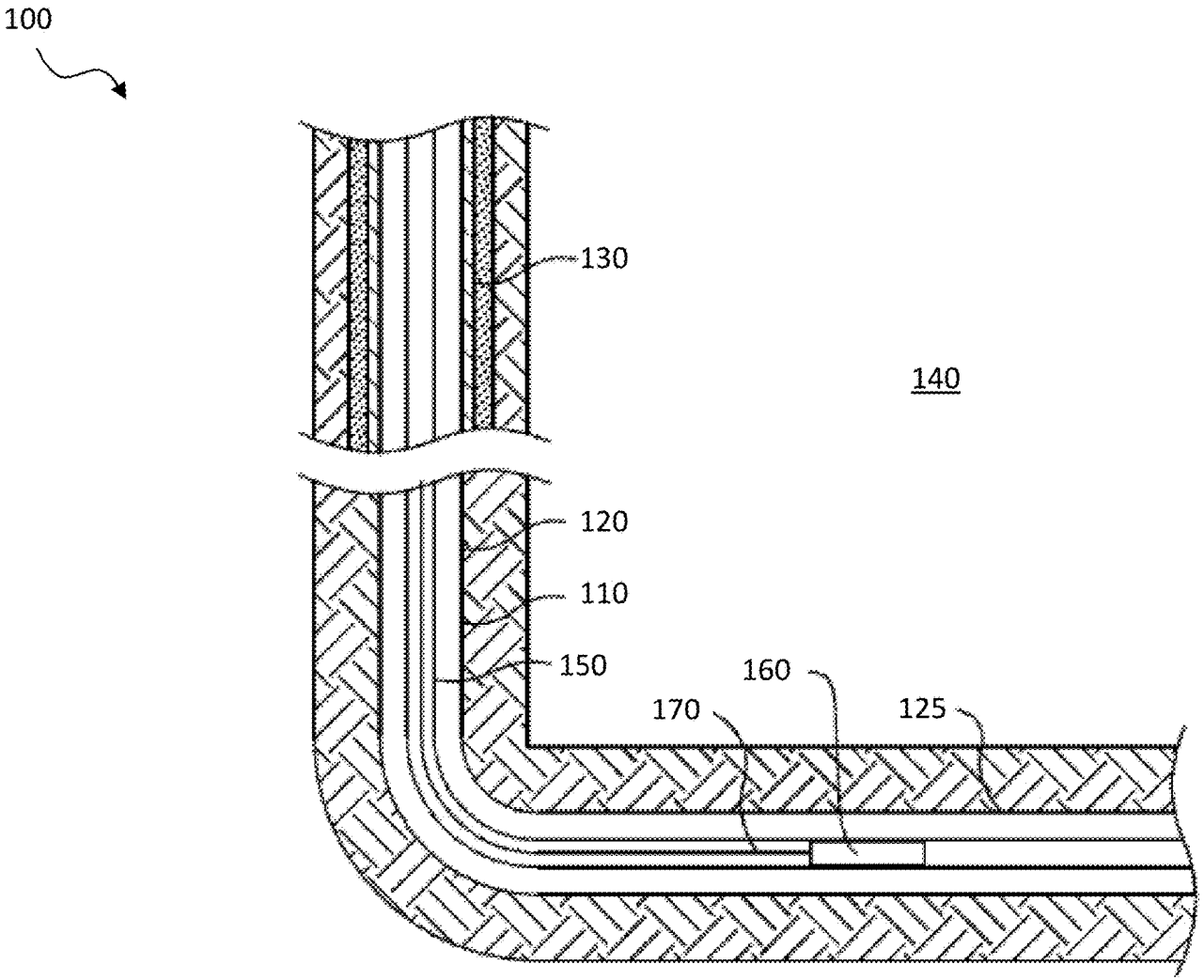
FIG. 1 illustrates a well system in which a radial cutter designed and manufactured according to the disclosure is deployed.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The description and drawings included herein merely illustrate the principles of the disclosure. It will thus be appreciated that those skilled in the art will be able to devise various arrangements that, although not explicitly described or shown herein, embody the principles of the disclosure and are included within its scope.

FIG. 1 schematically depicts an example of a well system 100 in which a radial cutter 160 designed and manufactured according to the disclosure is deployed. The well system 100 includes a wellbore 110 extending through various earth strata. The wellbore 110 has a substantially vertical section 120 and a substantially horizontal section 125. The substantially vertical section 120 and/or the substantially horizontal section 125 can include a casing string 130 cemented at an upper portion of the substantially vertical section 120. The substantially horizontal section 125, in the embodiment shown, extends through a hydrocarbon bearing subterranean formation 140.

A tubing string 150 within the wellbore 110 can extend from the surface to the subterranean formation 140. The tubing string 150 can provide a conduit for formation fluids, such as production fluids produced from the subterranean formation 140, to travel from the substantially horizontal section 125 to the surface. Pressure from a bore in a subterranean formation 140 can cause formation fluids, including production fluids such as gas or petroleum, to flow to the surface.

A radial cutter 160 can be deployed into the well system 100. In some aspects, the radial cutter 160 can be detonated to cut a portion of the tubing string 150, for example separating the single portion of the tubing string 150 into two portions. The radial cutter 160 can be deployed into the tubing string 150 on a conveyance mechanism 170, which may include a wireline or other suitable mechanism. In other aspects, the radial cutter 160 can be deployed as part of the tubing string 150 and the conveyance mechanism 170 can be omitted.

Although the well system 100 is depicted with one radial cutter 160, any number of radial cutters 160 can be used in the well system 100. Although FIG. 1 depicts the radial cutter 160 in the substantially horizontal section 125, the radial cutter 160 can be located, additionally or alternatively, in the substantially vertical section 120. In some aspects, the radial cutter 160 can be disposed in simpler wellbores, such as wellbores having only a substantially vertical section. The radial cutter 160 can be disposed in openhole environments, as depicted in FIG. 1, or in cased wells.

Figure 2A:
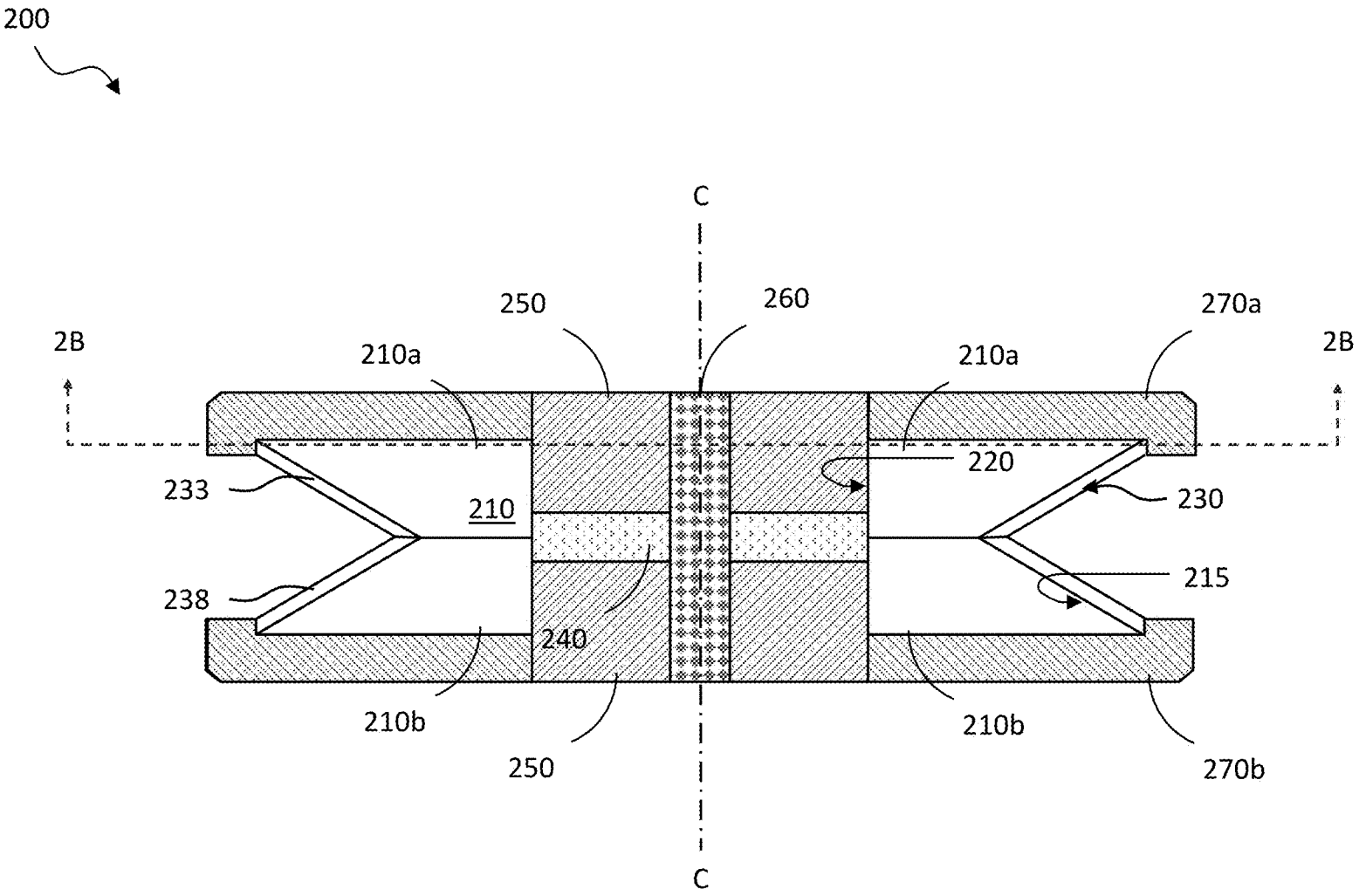
FIGS. 2A and 2B illustrate different cross-sectional views of one embodiment of a shaped charge manufactured and designed in accordance with the disclosure.
Figure 2B:
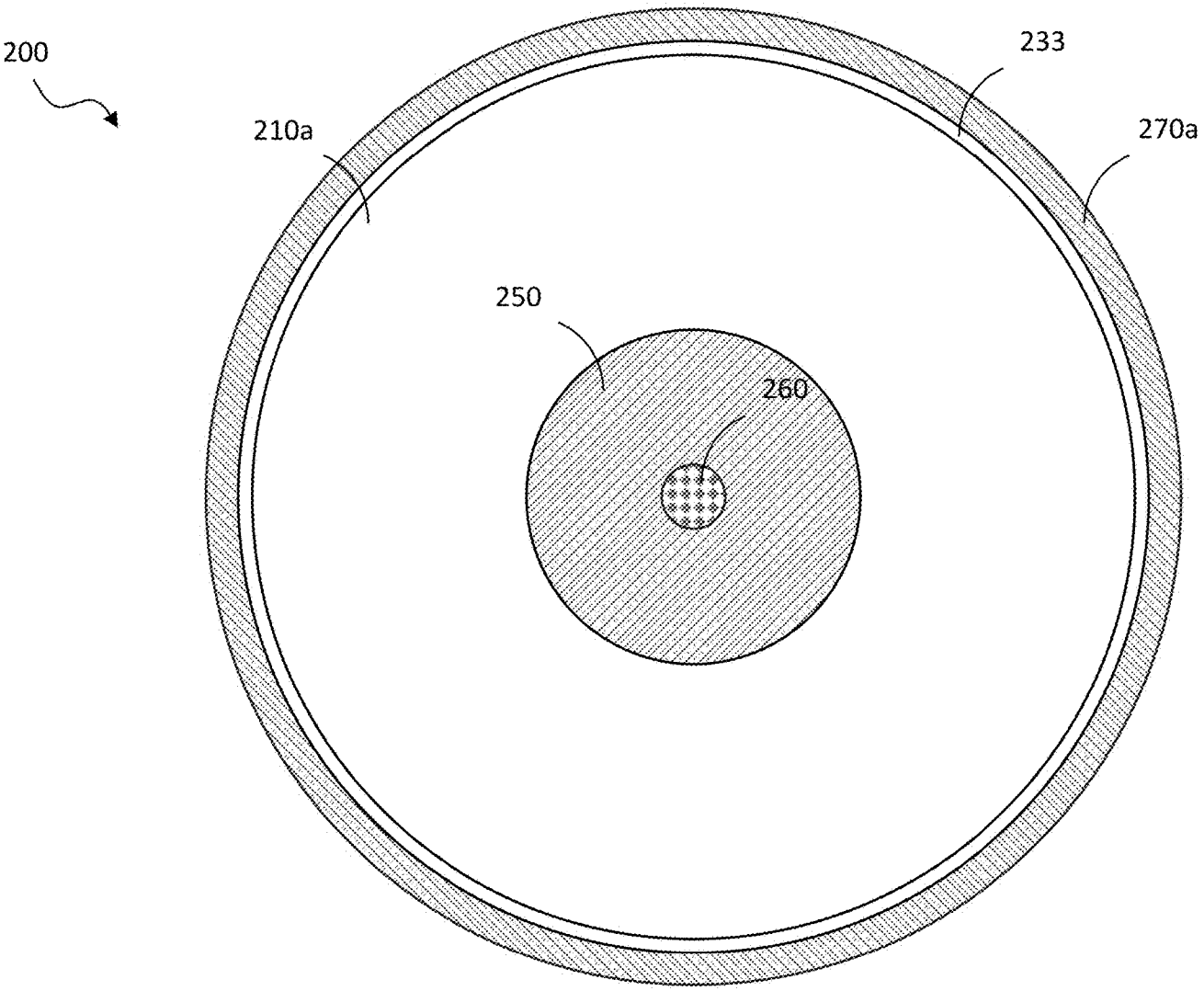

Turning to FIGS. 2A and 2B. illustrated are different cross-sectional views of a shaped charge 200 manufactured and designed in accordance with the disclosure. The shaped charge 200, in accordance with the disclosure, includes a circular charge 210. The circular charge 210, in the embodiment shown, is formed into a predetermined shape having a concave edge 215. In the illustrated embodiment of FIGS. 2A and 2B, the circular charge 210 includes a pair of circular half charges 210*a*, 210*b*. In other embodiments, however, the circular charge 210 does not include the pair of circular half charges, and thus could comprise a single preformed piece.

The pair of circular half charges 210*a*, 210*b*, in the illustrated embodiment, are formed into the predetermined shape. For example, the predetermined shape could be selected to form the concave edge 215 when the pair of circular half charges 210*a*, 210*b* are placed proximate one another. In the illustrated embodiment, the concave edge 215 is in the shape of a V, but the concave edge 215 could embody different concave shapes (e.g., shape of a U, etc.) and remain within the purview of the disclosure. The predetermined shape of the circular charge 210, and thus the circular half charges 210*a*, 210*b* illustrated in FIGS. 2A and 2B, may also be formed to have corresponding circular openings 220 centered substantially about a centerline C-C thereof. The term "substantially," as used herein with regard to openings, means that the openings are located within 10 percent of the centerline C-C.

While not easily illustrated given the section view of the shaped charge 200, each of the pair of circular half charges 210*a*, 210*b*, may comprise a plurality of segments. For example, each of the pair of circular half charges 210*a*, 210*b*, may comprise two 180 degree segments, which together form each of the circular half charges 210*a*, 210*b*. In another example, each of the pair of circular half charges 210*a*, 210*b*, may comprise four 90 degree segments, which together form each of the circular half charges 210*a*, 210*b*. The number of segments for each circular half charge 210*a*, 210*b* may vary, so long as they generally end up being circular in nature. Accordingly, the present disclosure should not be limited to any specific number of segments.

In accordance with the disclosure, the circular charge 210, and thus each of the pair of circular half charges 210*a*, 210*b*, is formed from a Triaminotrinitrobenzene based material. The term "Triaminotrinitrobenzene," as used herein, is synonymous with 1,3,5-Triamino-2,4,6-Trinitrobenzene and/or TATB, which all have the chemical formula $C_6(NO_2)_3(NH_2)_3$. For discussion purposes, Triaminotrinitrobenzene may be referred to throughout the present disclosure as TATB. The phrases "Triaminotrinitrobenzene based material" or "TATB based material," as used herein, include any material having TATB therein. While many different TATB based material may be used for the circular charge 210, certain combinations have been found to be particularly useful.

For example, the circular charge 210 could comprise approximately 95 weight percent TATB and approximately 5 weight percent PolyChloroTriFluoroEthylene, which may exist under the tradename PBX 9502. Alternatively, the circular charge 210 could comprise approximately 80 weight percent TATB, approximately 15 weight percent cyclotetramethylene-tetranitramine, and approximately 5 weight percent PolyChloroTriFluoroEthylene, which may exist under the tradename PBX 9503. Additionally, the circular charge 210 could comprise approximately 92.5 weight percent TATB and approximately 7.5 weight percent PolyChloroTriFluoroEthylene, which may exist under the tradename LX-17. In yet another embodiment, the circular charge 210 could comprise approximately 60 weight percent TATB, approximately 35 weight percent cyclotetramethylene-tetranitramine, and approximately 5 weight percent of a polymer-bonded explosive (e.g., Viton), which may exist under the tradename PBXN-7. Not only may the weight percent of TATB in the TATB based material change, the median particle size of the TATB based material may change. For example, the TATB based material could have a median particle size of 5 μm or less, which may exist under the tradename ufTATB. One or more of the TATB based material examples given above may be purchased from EURENCO Bofors Inc., having a principal place of business of 20130 Lakeview Plaza Center, Suite 400, Ashburn, VA 20147, or the Holston Army Ammunition Plant, having a principal place of business of 4509 W. Stone Drive, Kingsport, TN 37660. While a number of different TATB based materials have been focused upon, unless otherwise stated, the present disclosure should not be limited to any specific TATB based material.

The shaped charge 200, in the embodiment of FIGS. 2A and 2B, additionally includes a liner 230 shaped to extend along the concave edge 215 of the circular charge 210, and thus the pair of circular half charges 210*a*, 210*b*. The liner 230, in the illustrated embodiment, is formed of two half liners 233, 238. Notwithstanding, other embodiments are envisioned wherein a single liner is employed. The liner 230 may comprise a variety of different materials and remain within the scope of the disclosure. For example, the liner 230 may comprise, among other materials not listed, a material selected from the group of copper, copper alloy, aluminum, aluminum alloy, tin, tin alloy, lead, lead alloy, powdered metal, powdered metal within a polymeric base and sintered metal. Notwithstanding the list given, the liner 230 should not be limited to any specific material.

In accordance with one embodiment of the disclosure, a circular booster charge 240 is positioned within the circular openings 220. The circular booster charge 240, as those skilled in the art may appreciate, may be used to assist in the explosive initiation of the circular charge 210. The circular booster charge 240 may comprise a variety of different materials and remain within the purview of the disclosure. Notwithstanding, given the use of the more stable TATB based material for the circular charge 210, certain embodiments may employ non-TATB based materials for the circular booster charge 240. For example, the circular booster charge 240 might comprise explosive materials such as HMX, RDX, PYX, HNS or PETN, among others.

The circular booster charge 240, in the illustrated embodiment, is positioned at a centerpoint axially in the shaped charge 200. For example, booster sleeves 250 may be used to axially position the shaped charge 200. The booster sleeves 250 may comprise many different materials (e.g., steel, aluminum, copper, brass, lead, tungsten, magnesium, powdered metal, plastic, etc.) and remain within the purview of the disclosure.

In accordance with one embodiment of the disclosure, a detonation feature 260 is axially positioned within the openings 220. For example, when used, the circular booster charge 240 and booster sleeves 250 might have openings centered substantially about the centerline C-C thereof. According to this embodiment, the detonation feature 260 could be axially positioned within the openings in the circular booster charge 240 and booster sleeves 250. The detonation feature 260 may comprise a variety of different materials and remain within the scope of the present disclosure. In one embodiment, however, the detonation feature 260 comprises a cylindrical tube filled with a relatively small amount of high explosive in a metal (e.g., aluminum) casing. The detonation feature 260 may or may not comprise a TATB based material.

In the illustrated embodiment, a pair of opposing circular retainer rings 270*a*, 270*b* are axially disposed about the pair of circular half charges 210*a*, 210*b*. For example, the pair of opposing circular retainer rings 270*a*, 270*b* may be used to sandwich the other features of the shaped charge 200 together. The pair of opposing circular retainer rings 270*a*, 270*b* may comprise many different materials (e.g., steel, aluminum, copper, brass, lead, tungsten, magnesium, powdered metal, plastic, etc.) and remain within the purview of the disclosure.

The shaped charge 200 illustrated in FIGS. 2A and 2B is configured to radial cut an object (e.g., tubing or another feature) positioned radially outside thereof. Thus, according to this embodiment the concave edge 215 is a concave outer edge facing radially outside. As will be discussed further below with regard to FIG. 4, the features of the shaped charge could be rearranged such that it is configured to cut an object (e.g., cable or another feature) positioned radially inside thereof. In this embodiment, the concave edge 215 might be a concave inside edge.

Figure 3:
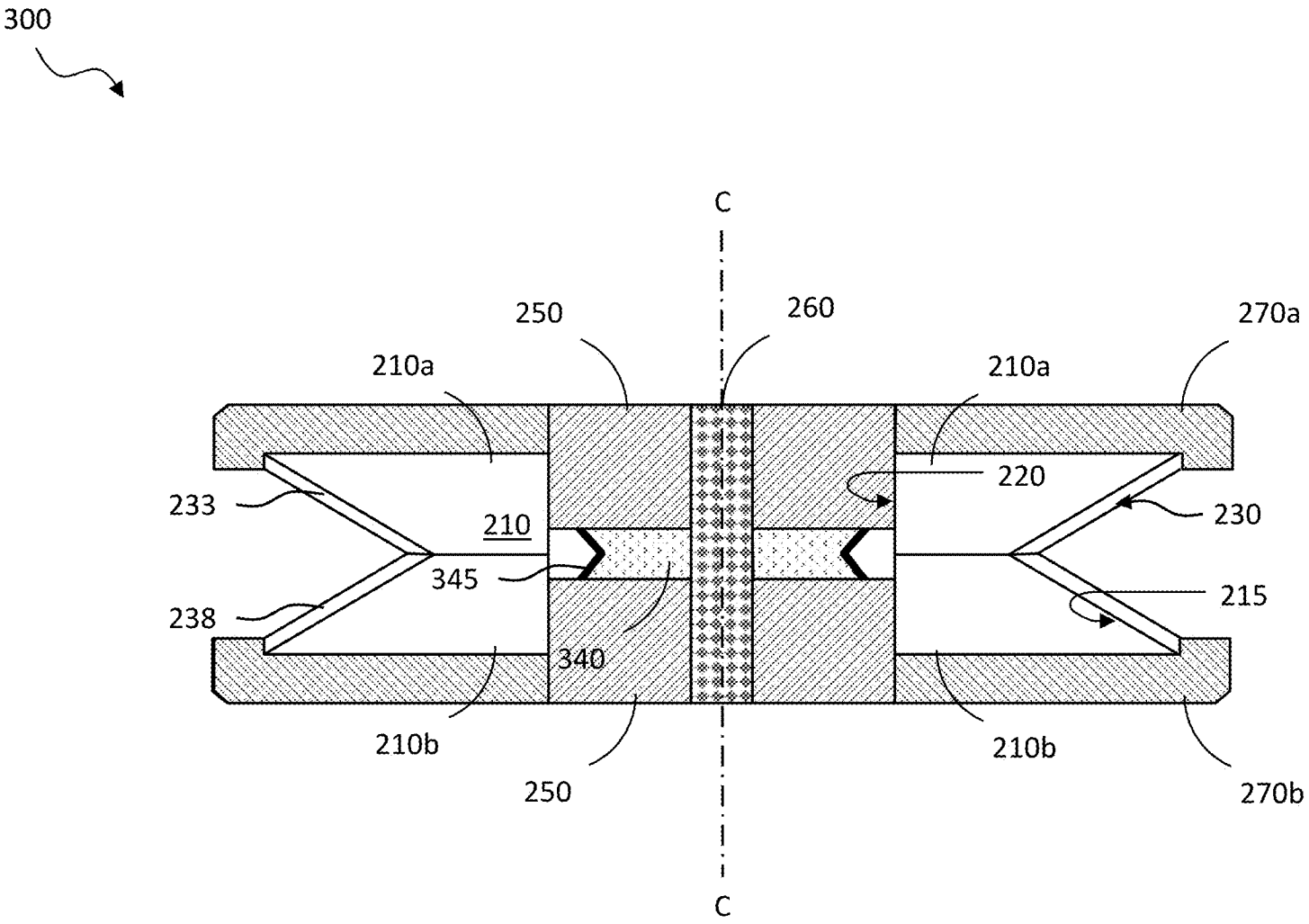
FIG. 3 illustrates an embodiment of a shaped charge manufactured and designed in accordance with an alternative embodiment of the disclosure.

Turning briefly to FIG. 3, illustrated is an alternative embodiment of a shaped charge 300 manufactured according to the disclosure. The shaped charge 300 is similar in many respects to the shaped charge 200 of FIGS. 2A and 2B. Accordingly, similar reference numbers may be used to reference like (e.g., substantially, exactly or otherwise) features. The shaped charge 300 primarily differs from the shaped charge 200 of FIGS. 2A and 2B, in that it includes a different booster charge 340. The booster charge 340, in the embodiment of FIG. 3 and in accordance with this disclosure, is formed into a second predetermined shape having a second concave edge (e.g., outer edge), as shown. The second concave edge, when used, may have a flyer plate 345 that is shaped to extend along the second concave edge. The flyer plate 345, in this embodiment, is configured to be radially ejected toward an inner radial surface of the circular charge 210 (e.g., pair of circular half charges 210*a*, 210*b* in the embodiment shown) when the booster charge 340 is initiated, and thus assist in the initiation of the circular charge 210 by increasing the pressure thereon.

The flyer plate 345 may comprise a variety of different materials and remain within the scope of the disclosure. In one embodiment, however, the flyer plate 345 comprises a material selected from the group of copper, copper alloy, aluminum, aluminum alloy, tin, tin alloy, lead, lead alloy, powdered metal, powdered metal within a polymeric base and sintered metal, among others. The flyer plate 345 and the second concave edge are illustrated in FIG. 3 as being concave shaped, but it should be noted that non-concave shaped outer edges and flyer plates 345 are within the purview of the disclosure.

A flyer plate, such as the flyer plate 345 of FIG. 3, may allow the shaped charge 300 to employ a different material for the booster charge 340. For instance, a TATB based material might be used for the booster charge 340, as a more unstable explosive material is not necessary given the inclusion of the flyer plate 345. Notwithstanding the foregoing, the flyer plate 345 could also be used with a booster charge comprising explosive materials such as HMX, RDX, PYX, HNS or PETN, among others.

The embodiment of FIG. 3 employs the flyer plate 345 to increase the input pressure into the pair of circular half charges 210*a*, 210*b*. Other mechanisms, however, may also be used to increase the input pressure. For example, in lieu of the flyer plate 345, a small booster jet or slapper might be used to increase the pressure.

Figure 4:
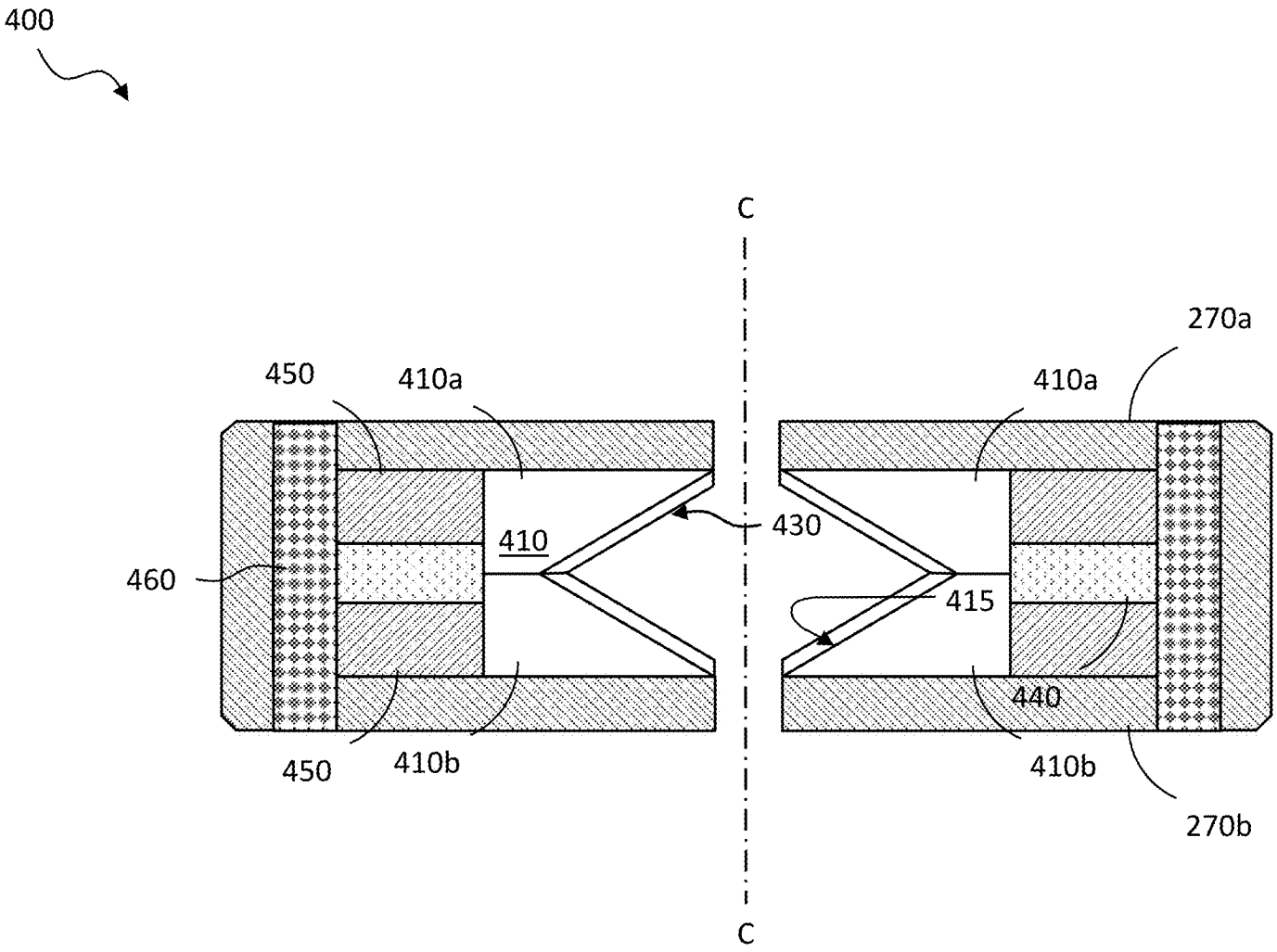
FIG. 4 illustrates yet another embodiment of a shaped charge manufactured and designed in accordance with an alternative embodiment of the disclosure.

Turning briefly to FIG. 4, illustrated is yet another alternative embodiment of a shaped charge 400 manufactured according to the disclosure. The shaped charge 400 is similar in many respects to the shaped charge 200 of FIGS. 2A and 2B. Accordingly, similar reference numbers may be used to reference like (e.g., substantially, exactly or otherwise) features. The shaped charge 400 primarily differs from the shaped charge 200 of FIGS. 2A and 2B, in that it is configured to cut an object (e.g., cable or other structure) positioned radially inside thereof. According to this embodiment, the concave edge 415 of the circular charge 410 would be a concave inside edge facing radially inward, with the liner 430 shaped to extend along the concave edge 415. Additionally, the booster charge 440, booster sleeves 450 and a detonation feature 460 (e.g., detonation ring), in the illustrated embodiment, are positioned radially outside of the circular charge 410.

Figure 5:
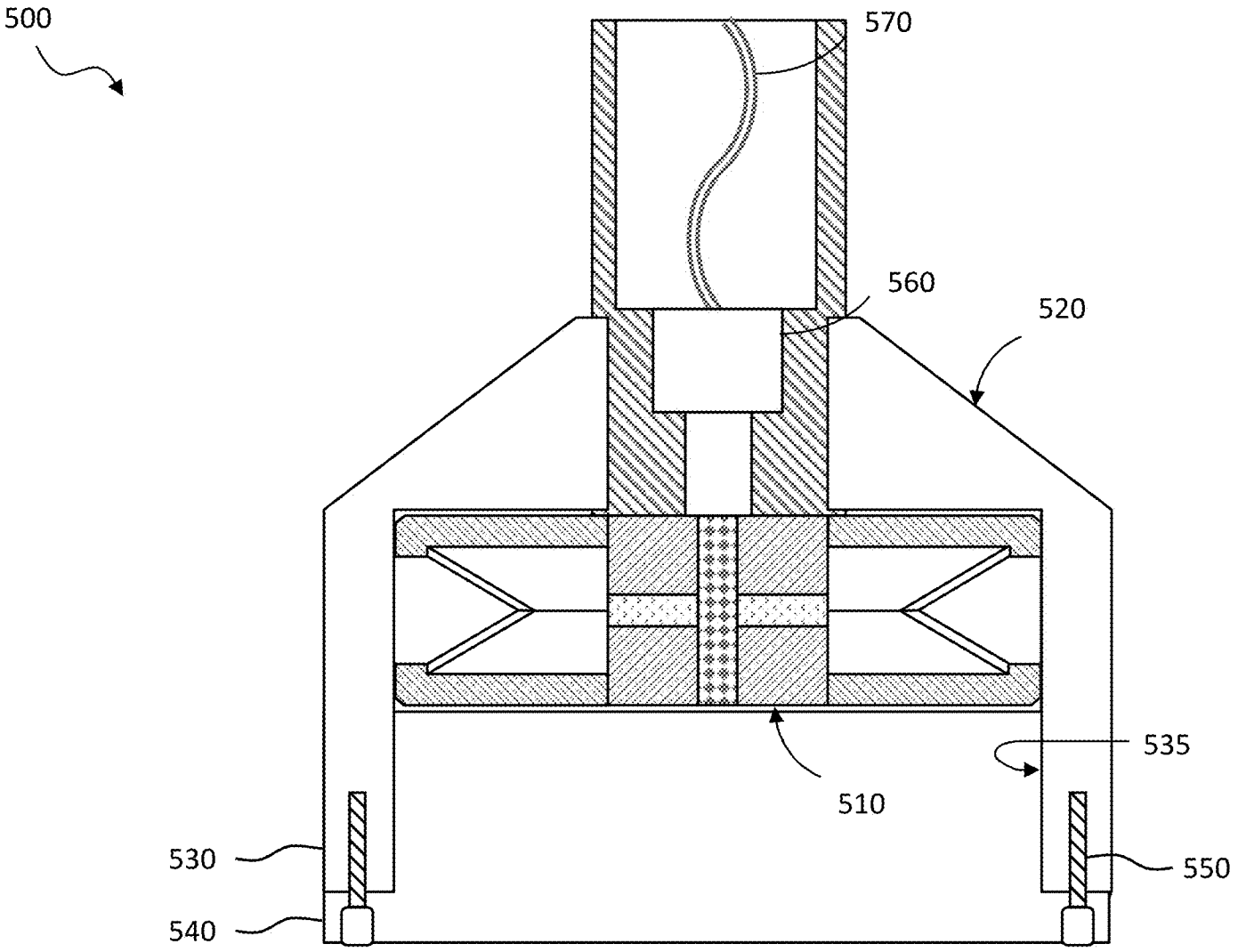
FIG. 5 illustrates a radial cutter designed and manufactured according to the disclosure.

Turning to FIG. 5, illustrated is a radial cutter 500 designed and manufactured according to the disclosure. The radial cutter 500 includes a shaped charge 510 manufactured according to the disclosure. The shaped charge 510, in one embodiment, is similar in many respects to the shaped charges 200, 300, 400 illustrated in FIGS. 2-4. Other shaped charges different from those illustrated in FIGS. 2-4, however, may also be used.

The shaped charge 510, in the illustrated embodiment, is substantially enclosed by a cartridge assembly 520. The cartridge assembly 520 may comprise a variety of different features, shapes and materials and remain within the scope of the disclosure. In the illustrated embodiment of FIG. 5, however, the cartridge assembly 520 comprises steel, and includes a main portion 530 having an opening 535 defined therein, and a cap portion 540. It should be noted that the cartridge assembly 520 may comprise many different materials other than steel (e.g., aluminum, copper, brass, lead, tungsten, magnesium, powdered metal, plastic, etc.) and remain within the purview of the disclosure. According to this embodiment, the shaped charge 510 would be positioned within the opening 535 in the main portion 530, and then the cap portion 540 would be placed there over and secured with one or more fasteners 550. The radial cutter 500, in the illustrated embodiment, additionally includes a detonator 560, which may be attached to a detonator cord 570, among other features not illustrated.

The relative insensitive nature of TATB based materials allows larger gram weight radial cutters to pass the UN Series 6C test. When this test is passed, such radial cutters may be shipped under the Department of Transportations (DOT) shipping classification 1.4D, instead of the current 1.1D classification. The 1.4D classification provides for a less restrictive and costly shipping class. While radial cutters employing TATB based materials do not exhibit as high of an energy output (performance potential) as the traditional oilfield explosives HMX, RDX, or PETN, they will still function with these new designs discussed above.

Aspects disclosed herein include:

A. A shaped charge for use in a radial cutter, comprising: a circular charge formed into a predetermined shape, the predetermined shape selected to form a concave edge, wherein the circular charge is formed from a Triaminotrinitrobenzene based material; and a liner shaped to extend along the concave edge.

B. A method for cutting a downhole object, comprising: 1) placing a radial cutter within a tubular in a wellbore using a conveyance, the radial cutter including; a shaped charge, the shaped charge including; a) a circular charge formed into a predetermined shape, the predetermined shape selected to have a circular opening centered substantially about a centerline thereof and form a concave edge, wherein the circular charge is formed from a Triaminotrinitrobenzene based material; b) a liner shaped to extend along the concave edge; and c) a detonation feature axially positioned proximate the circular charge; and a pair of opposing circular retainer rings axially disposed about the circular charge; a cartridge assembly substantially enclosing the shaped charge; and 2) detonating the radial cutter using the detonation feature to cut an object positioned radially outside or radially inside the shaped charge.

Aspects A, B, and C may have one or more of the following additional elements in combination: Element 1: wherein the Triaminotrinitrobenzene based material comprises approximately 95 weight percent Triaminotrinitrobenzene and approximately 5 weight percent PolyChloroTriFluoroEthylene. Element 2: wherein the Triaminotrinitrobenzene based material comprises approximately 80 weight percent Triaminotrinitrobenzene, approximately 15 weight percent cyclotetramethylene-tetranitramine, and approximately 5 weight percent PolyChloroTriFluoroEthylene. Element 3: wherein the Triaminotrinitrobenzene based material comprises approximately 92.5 weight percent Triaminotrinitrobenzene and approximately 7.5 weight percent PolyChloroTriFluoroEthylene. Element 4: wherein the Triaminotrinitrobenzene based material comprises approximately 60 weight percent Triaminotrinitrobenzene, approximately 35 weight percent cyclotramethylene-tetranitramine, and approximately 5 weight percent of a polymer-bonded explosive. Element 5: wherein the Triaminotrinitrobenzene based material has a median particle size of 5 μm or less. Element 6: wherein the circular charge has a corresponding circular opening centered substantially about a centerline thereof, and further wherein a circular booster charger is positioned within the circular opening. Element 7: wherein the circular booster charge is formed from a non-Triaminotrinitrobenzene based material. Element 8: wherein the circular booster charge is formed into a second predetermined shape having a second concave edge, and further wherein a flyer plate is shaped to extend along the second concave edge. Element 9: wherein the circular booster charge is formed from a Triaminotrinitrobenzene based material. Element 10: wherein the circular charge has a corresponding circular opening centered substantially about a centerline thereof, and further wherein a detonation feature is axially positioned within the circular opening. Element 11: wherein the circular charge is a pair of circular half charges, and further wherein the pair of circular half charges are placed proximate one another to form the concave edge. Element 12: wherein each of the pair of circular half charges comprises a plurality of segments. Element 13: wherein the concave edge is a concave outside edge. Element 14: wherein the concave edge is a concave inside edge. Element 15: wherein the liner is formed of two half liners. Element 16: wherein the liner comprises a material selected from the group of copper, copper alloy, aluminum, aluminum alloy, tin, tin alloy, lead, lead alloy, powdered metal, powdered metal within a polymeric base and sintered metal. Element 17: wherein the circular charge is positioned between a pair of opposing circular retainer rings.

Those skilled in the art to which this application relates will appreciate that other and further additions, deletions, substitutions and modifications may be made to the described embodiments.

What is claimed is:

1. A shaped charge for use in a radial cutter, comprising:

a disk-shaped charge having first and second opposing primary surfaces and a concave edge adjoining the first and second opposing surfaces, wherein the disk-shaped charge is formed from a Triaminotrinitrobenzene based material, and further wherein the disk-shaped charge has a corresponding circular opening centered substantially about a centerline thereof, the circular opening having an opening face that is perpendicular to the first and second opposing primary surfaces;

a liner shaped to extend along the concave edge;

a circular booster charge positioned within the circular opening, wherein the circular booster charge is formed into a shape having a second concave edge, the second concave edge pointed in a same direction as the concave edge of the disk-shaped charge and pointed toward the opening face that is perpendicular to the first and second opposing primary surfaces and pointed in a same direction as the concave edge; and a flyer plate shaped to extend along the second concave edge, the flyer plate located between the circular booster charge and the opening face that is perpendicular to the first and second opposing primary surfaces.

2. The shaped charge as recited in claim 1, wherein the Triaminotrinitrobenzene based material comprises approximately 95 weight percent Triaminotrinitrobenzene and approximately 5 weight percent PolyChloroTriFluoroEthylene.

3. The shaped charge as recited in claim 1, wherein the Triaminotrinitrobenzene based material comprises approximately 80 weight percent Triaminotrinitrobenzene, approximately 15 weight percent cyclotetramethylene-tetranitramine, and approximately 5 weight percent PolyChloroTriFluoroEthylene.

4. The shaped charge as recited in claim 1, wherein the Triaminotrinitrobenzene based material comprises approximately 92.5 weight percent Triaminotrinitrobenzene and approximately 7.5 weight percent PolyChloroTriFluoroEthylene.

5. The shaped charge as recited in claim 1, wherein the Triaminotrinitrobenzene based material comprises approximately 60 weight percent Triaminotrinitrobenzene, approximately 35 weight percent cyclotetramethylene-tetranitramine, and approximately 5 weight percent of a polymer-bonded explosive.

6. The shaped charge as recited in claim 1, wherein the Triaminotrinitrobenzene based material has a median particle size of 5 μm or less.

7. The shaped charge as recited in claim 1, wherein the circular booster charge is formed from a non-Triaminotrinitrobenzene based material.

8. The shaped charge as recited in claim 1, wherein the circular booster charge is formed from a Triaminotrinitrobenzene based material.

9. The shaped charge as recited in claim 1, further including a detonation feature is axially positioned within the circular opening.

10. The shaped charge as recited in claim 1, wherein the disk-shaped charge is a pair of disk-shaped half charges, and further wherein the pair of dish-shaped half charges are placed proximate one another to form the concave edge.

11. The shaped charge as recited in claim 10, wherein each of the pair of disk-shaped half charges comprises a plurality of segments.

12. The shaped charge as recited in claim 1, wherein the concave edge is a concave outside edge.

13. The shaped charge as recited in claim 1, wherein the concave edge is a concave inside edge.

14. The shaped charge as recited in claim 1, wherein the liner is formed of two half liners.

15. The shaped charge as recited in claim 1, wherein the liner comprises a material selected from the group of copper, copper alloy, aluminum, aluminum alloy, tin, tin alloy, lead, lead alloy, powdered metal, powdered metal within a polymeric base and sintered metal.

16. The shaped charge as recited in claim 1, wherein the disk-shaped charge is positioned between a pair of opposing circular retainer rings.

17. A method for cutting a downhole object, comprising:

placing a radial cutter within a tubular in a wellbore using a conveyance, the radial cutter including;

a shaped charge, the shaped charge including;

a disk-shaped charge formed into a predetermined shape, the predetermined shape selected to have a circular opening centered substantially about a centerline thereof and form a concave edge, wherein the disk-shaped charge is formed from a Triaminotrinitrobenzene based material, and further wherein the circular opening has an opening face that is perpendicular to the first and second opposing primary surfaces;

a liner shaped to extend along the concave edge;

a circular booster charge positioned within the circular opening, wherein the circular booster charge is formed into a shape having a second concave edge, the second concave edge pointed in a same direction as the concave edge of the disk-shaped charge and pointed toward the opening face that is perpendicular to the first and second opposing primary surfaces and pointed in a same direction as the concave edge; and a flyer plate shaped to extend along the second concave edge, the flyer plate located between the circular booster charge and the opening face that is perpendicular to the first and second opposing primary surfaces; and a detonation feature axially positioned proximate the disk-shaped charge; and a pair of opposing circular retainer rings axially disposed about the disk-shaped charge;

a cartridge assembly substantially enclosing the shaped charge; and detonating the radial cutter using the detonation feature to cut an object positioned radially outside or radially inside the shaped charge.

18. The method as recited in claim 17, wherein the Triaminotrinitrobenzene based material comprises approximately 95 weight percent Triaminotrinitrobenzene and approximately 5 weight percent PolyChloroTriFluoroEthylene.

19. The method as recited in claim 17, wherein the Triaminotrinitrobenzene based material comprises approximately 80 weight percent Triaminotrinitrobenzene, approximately 15 weight percent cyclotetramethylene-tetranitramine, and approximately 5 weight percent PolyChloroTriFluoroEthylene.

20. The method as recited in claim 17, wherein the Triaminotrinitrobenzene based material comprises approximately 92.5 weight percent Triaminotrinitrobenzene and approximately 7.5 weight percent PolyChloroTriFluoroEthylene.

21. The method as recited in claim 17, wherein the Triaminotrinitrobenzene based material comprises approximately 60 weight percent Triaminotrinitrobenzene, approximately 35 weight percent cyclotetramethylene-tetranitramine, and approximately 5 weight percent of a polymer-bonded explosive.

22. The method as recited in claim 17, wherein the Triaminotrinitrobenzene based material has a median particle size of 5 μm or less.

23. The method as recited in claim 17, wherein the circular booster charge is formed from a non-Triaminotrinitrobenzene based material.

24. The method as recited in claim 17, wherein the circular booster charge is formed from a Triaminotrinitrobenzene based material.

25. The method as recited in claim 17, wherein the disk-shaped charge is a pair of disk-shaped half charges, and further wherein the pair of disk-shaped half charges are placed proximate one another to form the concave edge.

26. The method as recited in claim 17, wherein the concave edge is a concave outside edge.

27. The method as recited in claim 17, wherein the concave edge is a concave inside edge.

* * * * *